US007013108B2

(12) United States Patent
Takenaka et al.

(10) Patent No.: US 7,013,108 B2
(45) Date of Patent: Mar. 14, 2006

(54) FIXING DEVICE AND IMAGE FORMING DEVICE

(75) Inventors: Kohta Takenaka, Kanagawa-ken (JP); Hidehiko Fujiwara, Tokyo (JP); Masahiko Kamijoh, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/882,303

(22) Filed: Jul. 2, 2004

(65) Prior Publication Data

US 2004/0240914 A1 Dec. 2, 2004

Related U.S. Application Data

(63) Continuation of application No. 10/285,458, filed on Nov. 1, 2002, now Pat. No. 6,788,916.

(30) Foreign Application Priority Data

Nov. 28, 2001 (JP) ..... 2001-362570

(51) Int. Cl.
*G03G 15/20* (2006.01)

(52) U.S. Cl. ..... 399/328; 219/216

(58) Field of Classification Search ..... 399/328, 399/329, 320, 322; 219/216, 243, 245, 246, 219/388

See application file for complete search history.

(56) References Cited

U.S. PATENT DOCUMENTS

| | | | | |
|---|---|---|---|---|
| 5,046,146 A | 9/1991 | Bartman et al. | ..... | 219/216 |
| 6,542,712 B1 | 4/2003 | Kiuchi et al. | ..... | 399/328 |
| 2003/0016974 A1 | 1/2003 | Kiuchi | ..... | 399/328 |
| 2003/0026632 A1 | 2/2003 | Takenaka et al. | ..... | 399/328 |
| 2003/0063933 A1 | 4/2003 | Fujiwara et al. | ..... | 399/328 |

FOREIGN PATENT DOCUMENTS

| | | |
|---|---|---|
| JP | 8-262893 | 10/1996 |
| JP | 2000-029331 | 1/2000 |
| JP | 2002-055556 | 2/2002 |
| JP | 2002-082551 | 3/2002 |
| JP | 2002-082552 | 3/2002 |
| JP | 2002-082555 | 3/2002 |
| JP | 2002-082565 | 3/2002 |
| JP | 2002-082566 | 3/2002 |

*Primary Examiner*—Sophia S. Chen
(74) *Attorney, Agent, or Firm*—Oblon, Spivak, McClelland, Maier & Neustadt, P.C.

(57) ABSTRACT

A fixing device including a heat transmitting unit and a sheet unit. The heat transmitting unit has a heating source, which can be for example disposed inside the heat transmitting unit. The sheet unit is in contact with the heat transmitting unit for applying a pressure against the heat transmitting unit. One end of the sheet unit is fixed on an installation fitment that is arrange at an upstream side of a transporting direction of a recording paper with respect to the heat transmitting unit, and the other end of the sheet unit is pressed to be in contact with the heat transmitting unit. Furthermore, when the recording paper, where a toner image has been transferred thereon, passes through a nip portion between the heat transmitting unit and the sheet unit, the toner image is fixed by pressing and heating onto the recording paper.

18 Claims, 8 Drawing Sheets

FIXING DEVICE AND IMAGE FORMING DEVICE

CROSS-REFERENCE TO RELATED APPLICATION

This application is a continuation of and claims the benefit of priority under 35 U.S.C. §120 from U.S. Ser. No. 10/285,458, filed Nov. 1, 2002, now U.S. Pat. No. 6,788,916 and under 35 U.S.C. §119 from Japanese Patent Application Ser. No. 2001-362570, filed Nov. 28, 2001, the entire contents of each are hereby incorporated herein by reference.

BACKGROUND OF THE INVENTION

1. Field of the Invention

This invention relates in general to a fixing device and an image forming device, which can be used in a facsimile device, a printer, a copier, or a multi-function machine with the above functions.

2. Description of the Related Art

FIG. 7 is a side view of an inter structure of a facsimile device having a conventional fixing device and a conventional image forming device. The facsimile device comprises a main body 1, a process cartridge 2 comprising various process devices for performing image formation by an electronic photographic process is detachably mounted inside the main body 1, a photoreceptor 3 contained within the process cartridge 2, an optical writing device 4 that makes the photoreceptor 3 to scan by a modulated laser beam based on an image data, a paper cassette 5 for storing the recording paper, a paper-feeding roller 6 for feeding the recording paper from the paper cassette 5, a transferring roller 7 that is in contact with the photoreceptor 3 and is used for transferring the toner image formed on the photoreceptor 3 onto the recording paper, a fixing device 8 having a fixing roller 9 and a pressure roller 10, a paper-ejecting roller 11, a sealed sensor 12, and document stage 13 formed over the main body 1.

The document placed on the document stage 13 is passed through the sealed sensor 12 by a transport system, and then ejected to external. As the document passes through the sealed sensor 12, the image on the document is optically read by the sealed sensor 12. The image data, which is read by the sealed sensor 12 or input from an external source, is transmitted to the optical writing device 4. Based, on the image data, the optical writing device 4 emits a modulated laser beam to the surface of the uniformly charged photoreceptor 3, so that an electrostatic latent image is formed on the surface of the photoreceptor 3. Then, the toner is made to adhere to the electrostatic latent image to form a toner image, and the toner image is transferred onto the recording paper by the transferring roller 7. When the recording paper transported from the transferring roller 7 passes through nip portion between the fixing roller 9 and pressure roller 10 of the fixing device 8, the toner image on the recording paper is melted by pressing and heating so as to be fixed onto the recording paper. Thereafter, the recording paper is ejected to external through the paper-ejecting roller 11.

FIG. 8 is a side view of an inter structure of a conventional fixing device. The fixing device 8 further comprises a fixing heater 19 that is disposed in the fixing roller 9 and is used for heating the fixing roller 9, a temperature detecting device 20 for detecting the temperature of the fixing roller 9, a separating claw 14 for separating the recording paper attached on the fixing roller 9 from the fixing roller 9, a cleaning pad 15 that is in contact with the fixing roller is used for cleaning the fixing roller 9, a cleaning pad invasion regulating unit that is installed at the downstream side in the fixing roller 9's rotational direction with respect to the cleaning pad, and an entrance guiding plate 18 installed at the entrance of the recording paper in main body of the fixing device.

The recording paper where the toner image has been transferred enters the nip portion between the fixing roller 9 and the pressure roller 10 through the entrance guiding plate 18. After the toner image is fixed onto the recording paper by pressing and heating at the nip portion, the recording paper is ejected to the external through the paper-ejecting roller 11. When the recording paper passes through the nip portion, the toner stock on the fixing roller 9 is removed by the cleaning pad 15.

The surface temperature of the fixing roller 9 is detected by the temperature detecting device 20. According to a detected result of the temperature detecting device 20, a heating control of the fixing heater 19 is performed by a controlling device (not shown).

Conventionally, an infrared heater or a halogen heater is used as the fixing heater 19 in the fixing device 8, and a structure constituted of the fixing roller and the pressure roller pair is most common. The pressure roller is a structure that is made by forming silicon rubber on a core bar and then a mold-releasing layer (such as Teflon, registered Trademark) is formed on the silicon rubber, so that the heat capacity of the pressure roller becomes larger. At the beginning of heating, the pressure roller does not get warm easily, causing incomplete fixing problems. Furthermore, there is also a demerit that assembly parts have high cost. In addition, in order to assure a suitable nip width of the nip portion between the fixing roller and the pressure roller, a large pressing force (pressure) is required. Because of the pressure, stress will be imparted on the recording paper, causing fixing wrinkle problems.

Instead of the pressure roller, a nip portion is formed by pressing a sheet to be in contact with the fixing roller. For example, a fixing device, where an unfixed image is fixed onto the recording paper by making the recording paper to pass the nip portion, is well studied and researched. By the above structure, the sheet can be easily warmed up, and the nip width can be also assured.

However, when starting the fixing process, the surface temperature on the ends of the fixing roller is lower than that on the central portion because the heat is being conducted to the bearings. As a result, the fixing rate of the toner on the ends of the recording paper at the beginning is worse. Therefore, the effect of the fixing device using the sheet-shaped pressure unit cannot be achieved from using the pressure roller. Namely, to accelerate warming up easily at the beginning of the heating like in the case of the sheet-shaped pressure unit cannot be achieved by using the pressure roller.

To solve this problem, a method to increase the heat distribution at the ends is provided. However, this method arises a hot offset image when small size recording papers are continuously fed, or increases thermal damages at the bearings.

SUMMARY OF THE INVENTION

According to the foregoing description, an object of this invention is to provide a fixing device and an image forming device, in which a sheet-shaped pressure unit is used to improve the fixing property on the ends of the fixing roller.

According to the object(s) mentioned above, the present invention provides a fixing device, comprising: a heat transmitting unit and a sheet unit. The heat transmitting unit has a heating source, which can be for example, disposed inside the heat transmitting unit. The sheet unit is in contact with the heat transmitting unit for applying a pressure against the heat transmitting unit. One end of the sheet unit is fixed on an installation fitment that is arranged at an upstream side of a transporting direction of a recording paper with respect to the heat transmitting unit, and the other end of the sheet unit is pressed to be in contact with the heat transmitting unit. Furthermore, when the recording paper, where a toner image has been transferred thereon, passes through a nip portion between the heat transmitting unit and the sheet unit, the toner image is fixed through pressing and heating onto the recording paper. The length of the sheet unit in the recording paper transporting direction becomes shorter while approaching the central portion of the nip portion, and becomes longer than that at the two ends of the nip portion. According to this structure, because the nip width on the two ends of the heat transmitting unit at the nip portion between the heat transmitting unit and the sheet unit can be maintained, the recording paper can be pressed by the heat transmitting unit for a longer time, and therefore, the fixing property on the two ends of the heat transmitting unit at the beginning of the heating can be improved.

The fixing device can further comprises a sheet regulating unit for varying a height of the other end of the sheet unit. Accordingly, the nip width at the two ends of the heat transmitting unit can be adjusted according to the thickness of the recording paper.

The invention further provides an image forming device, comprising at least a fixing device as described above. According to the structure, the fixing property can be improved and a stable image can be formed.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
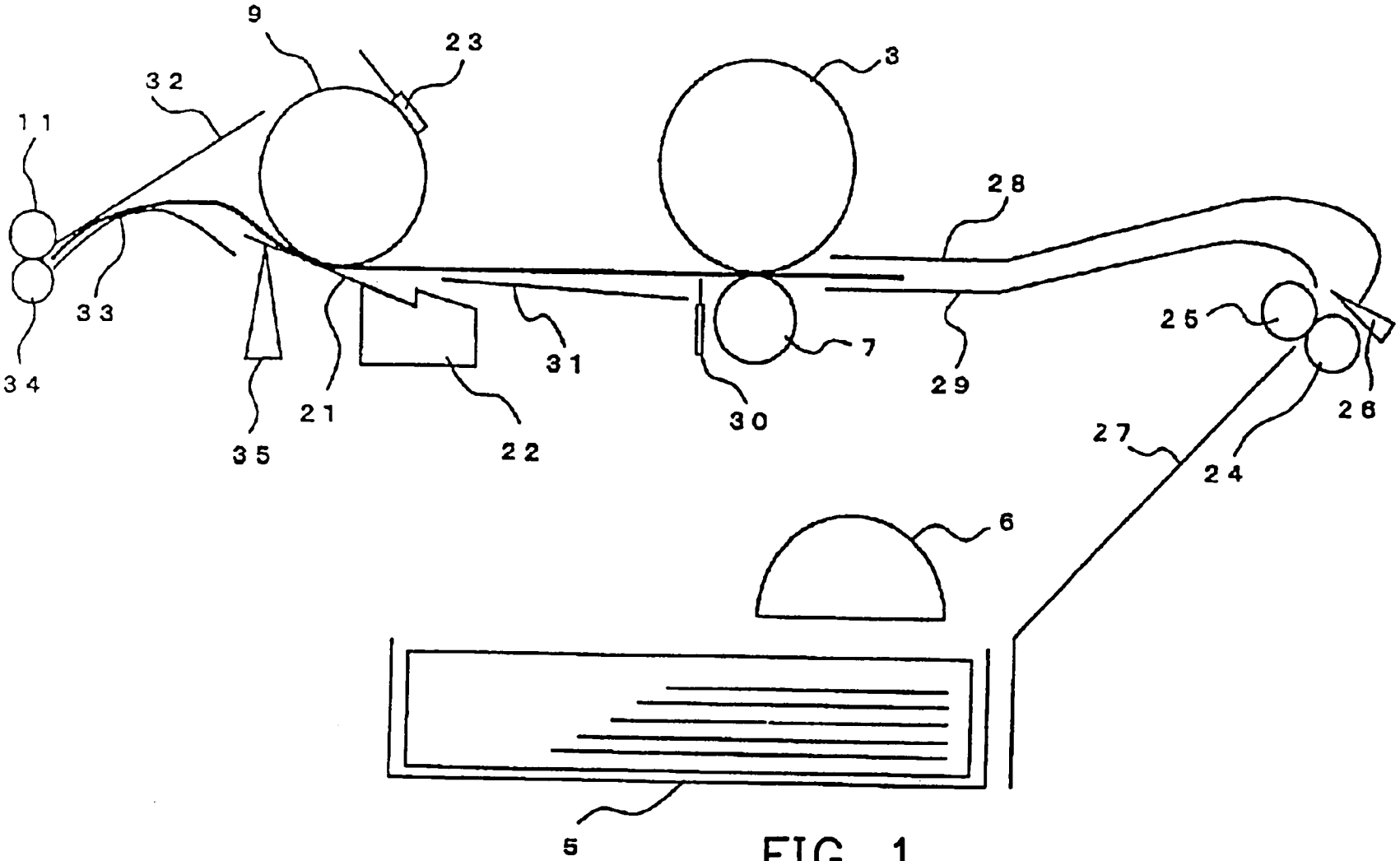
FIG. 1 shows an internal structure of a facsimile device having a fixing device and an image forming device according to the first embodiment of the invention.

The preferred embodiment of the present invention is described in detail in accordance with the attached drawings. FIG. 1 shows an internal structure of a facsimile device having a fixing device and an image forming device according to the first embodiment of the invention. The facsimile device comprises a fixing roller 9, a sheet unit 21, which is a plate having an elasticity, in contact with the fixing roller 9, a sheet unit attaching stage 22 for fitting one end of the sheet unit 21, a thermistor 23 that is in contact with the fixing roller 9 for detecting the temperature, a resist roller 24 that is arranged at a downstream side in the transporting direction of the recording paper with respect to the paper-feeding roller 6, a pressure roller 25 that is in contact with the resist roller 24, a resist sensor 26 that is arranged in the vicinity of the downstream side of the resist roller 24 in the transporting direction of the recording paper, a guiding plate 27 for guiding the recording paper from the paper-feeding roller 6 to the resist roller 24, an upper guiding plate 28 for guiding the upper surface of the recording paper from the resist roller 24 to the transferring roller 7, a lower guiding plate 29 that is opposite to the upper guiding plate 28 and used for guiding the lower surface of the recording paper from the resist roller 24 to the transferring roller 7, a charge removing brush 30 that is arranged in the vicinity of the downstream side of the transferring roller 7 in the transporting direction of the recording paper and is used for removing the residual charges on the recording paper that has passed the transferring roller 7, a pre-fixing guiding plate 31 for guiding the recording paper from the transferring roller 7 to the fixing roller 9, a post-fixing upper guiding plate 32 for guiding the upper surface of the recording paper from the fixing roller 9 to the paper-ejecting roller 11, a post-fixing lower guiding plate 33 for guiding the lower surface of the recording paper from the fixing roller 9 to the paper-ejecting roller 11, a pressure roller 34 for pressing in contact with the paper-ejecting roller 11, and a sheet unit position regulating unit 35 that is in contact with the other end of the opposite side of the contact surface between the fixing roller 9 and the sheet unit 21 and is used for regulating the lowest position of the sheet unit 21.

The sheet unit 21 is supported by the sheet unit attaching stage 22 in a cantilever manner. When the fixing roller 9 is installed, the sheet unit 21 is slightly bent to press against the fixing roller 9.

The recording paper transported by the paper-feeding roller 6 is guided by the guiding plate 27 to transport to the resist roller 24. When the resist sensor 26 detects the front end of the recording paper, the resist roller 24 stops rotating to interrupt the transportation of the recording paper. Afterwards, the resist roller 24 rotates again until such a time that the recording paper also reaches the nip portion when the toner image formed on the photoreceptor 3 reaches the nip portion between the transferring roller 7 and the photoreceptor 3. The recording paper transported by the resist roller 24 is guided by the upper guiding plate 28 and the lower guiding plate 29 to reach the nip portion between the transferring roller 7 and the photoreceptor 3. Then, the recording paper, which has passed the nip portion and the toner image has been transferred thereon, is further guided by the pre-fixing guiding plate 31 to reach the nip portion between the sheet unit 21 and the fixing roller 9. Afterwards, the recording paper, which has passed the nip portion and the toner image has been fixed, is further guided by the post-fixing upper guiding plate 32 and the post-fixing lower guiding plate 33 to reach the paper-ejecting roller 11. After passing the nip portion between the paper-ejecting roller 11 and the pressure roller 34, the recording paper is ejected to the external.

Figure 2:
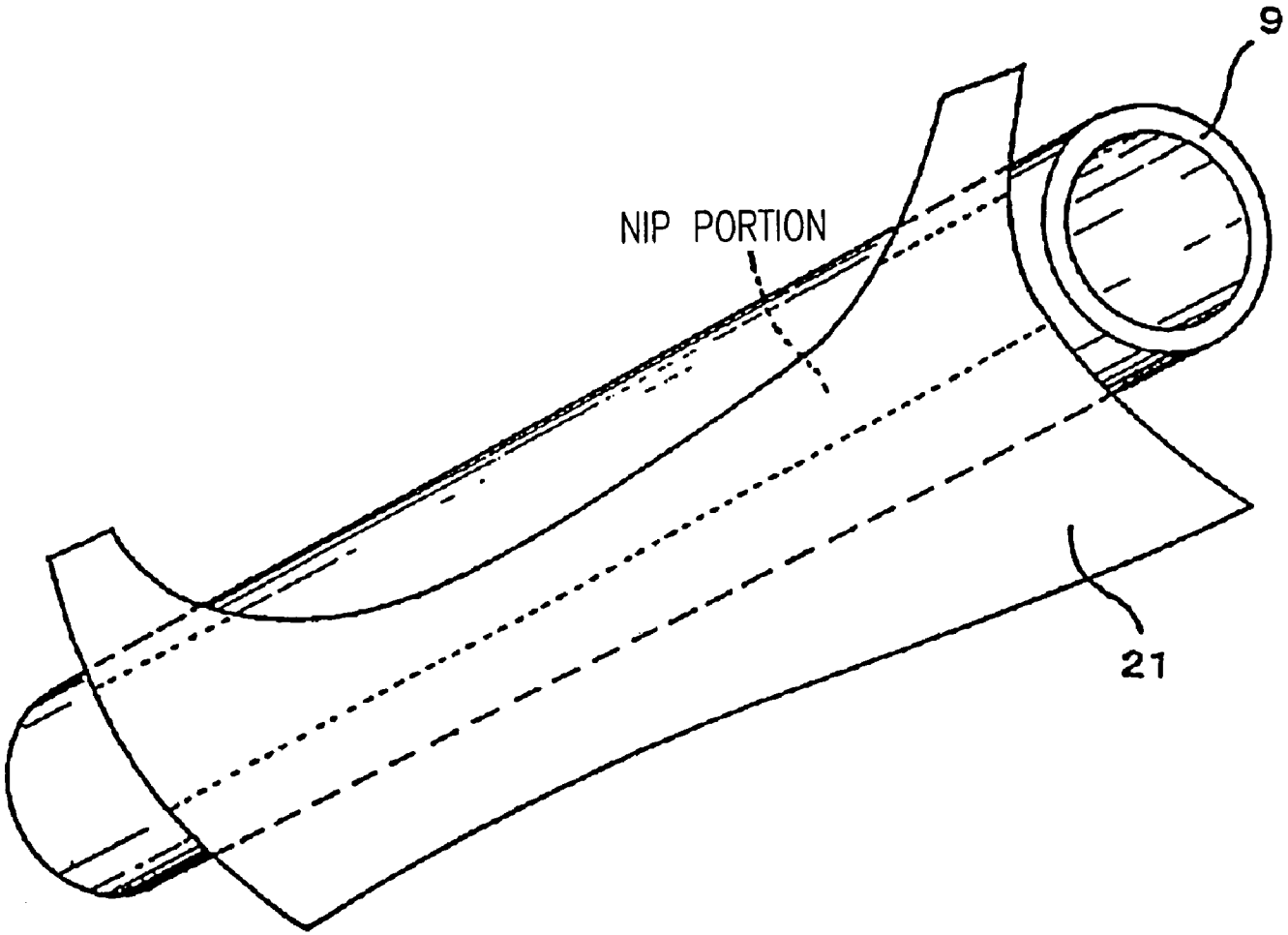
FIG. 2 is a perspective view showing the appearance of the sheet unit.
Figure 3:
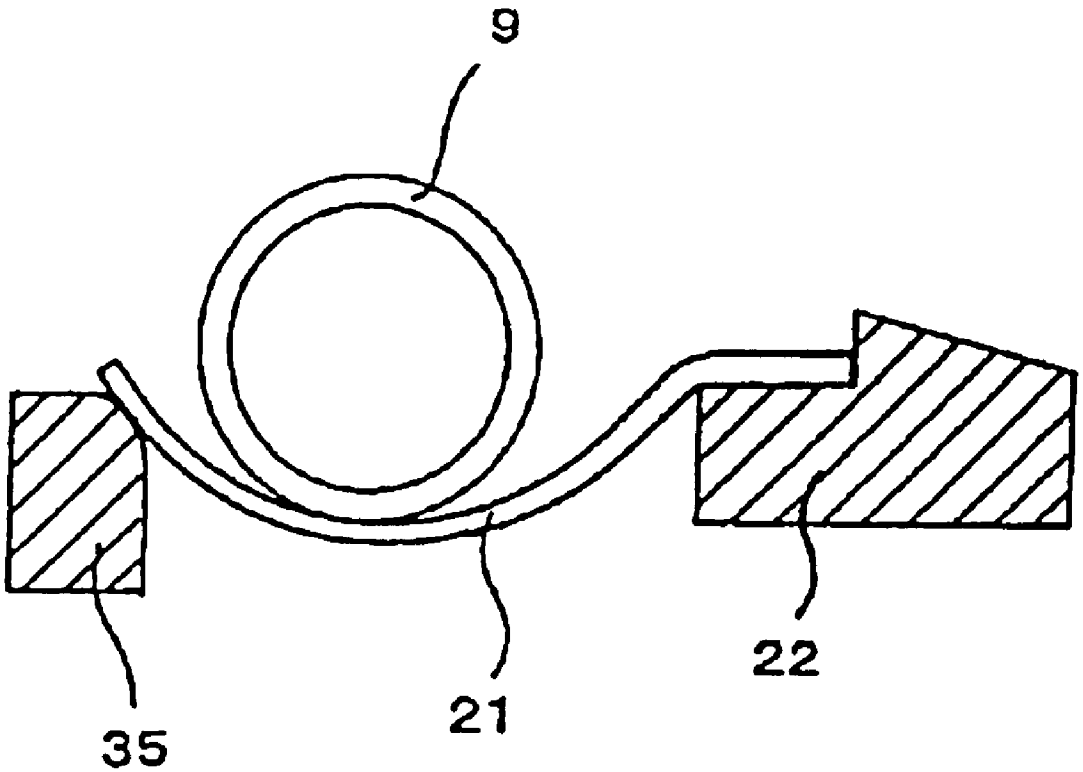
FIG. 3 is a side view showing a structure for installing the sheet unit in FIG. 2.

FIG. 2 is a perspective view showing the appearance of the sheet unit, and FIG. 3 is a side view showing a structure for installing the sheet unit in FIG. 2. A concave shape is formed at the other end of the sheet unit 21 (referring to FIG. 2). The length of the sheet unit 21 in the transporting direction of the recording paper is shorter while approaching the central portion of the sheet unit 21, and is longer than that at the ends. As shown in FIG. 3, when installing the fixing roller 9, the two ends of the other end of the sheet unit 21 are in contact with a sheet unit position regulating unit 35. By using the sheet unit position regulating unit 35, the position of the other end of the sheet unit 21 is regulated to prevent from dropping.

According to the aforementioned structure, at the nip portion between the fixing roller 9 and the sheet unit 21, the nip width on the two ends is larger than that on the central portion, thus the heat accumulation can be improved. In addition, because the two ends of the recording paper are in contact with the fixing roller for a longer time, the fixing property on the two ends of the fixing roller 9 can be improved.

When the sheet unit 21 is fixed at a lowest position, this situation cannot conform to various types of recording papers because the necessary nip width on the ends is different due to the different recording paper having different thickness. For example, if a thick recording paper is fed under a condition that the temperature and the nip width on the end are set for the thin recording paper, the fixing property on the end might not be as satisfying at the beginning of the fixing operation. Therefore, the second embodiment is provided and described in view if these problems.

Figure 4:
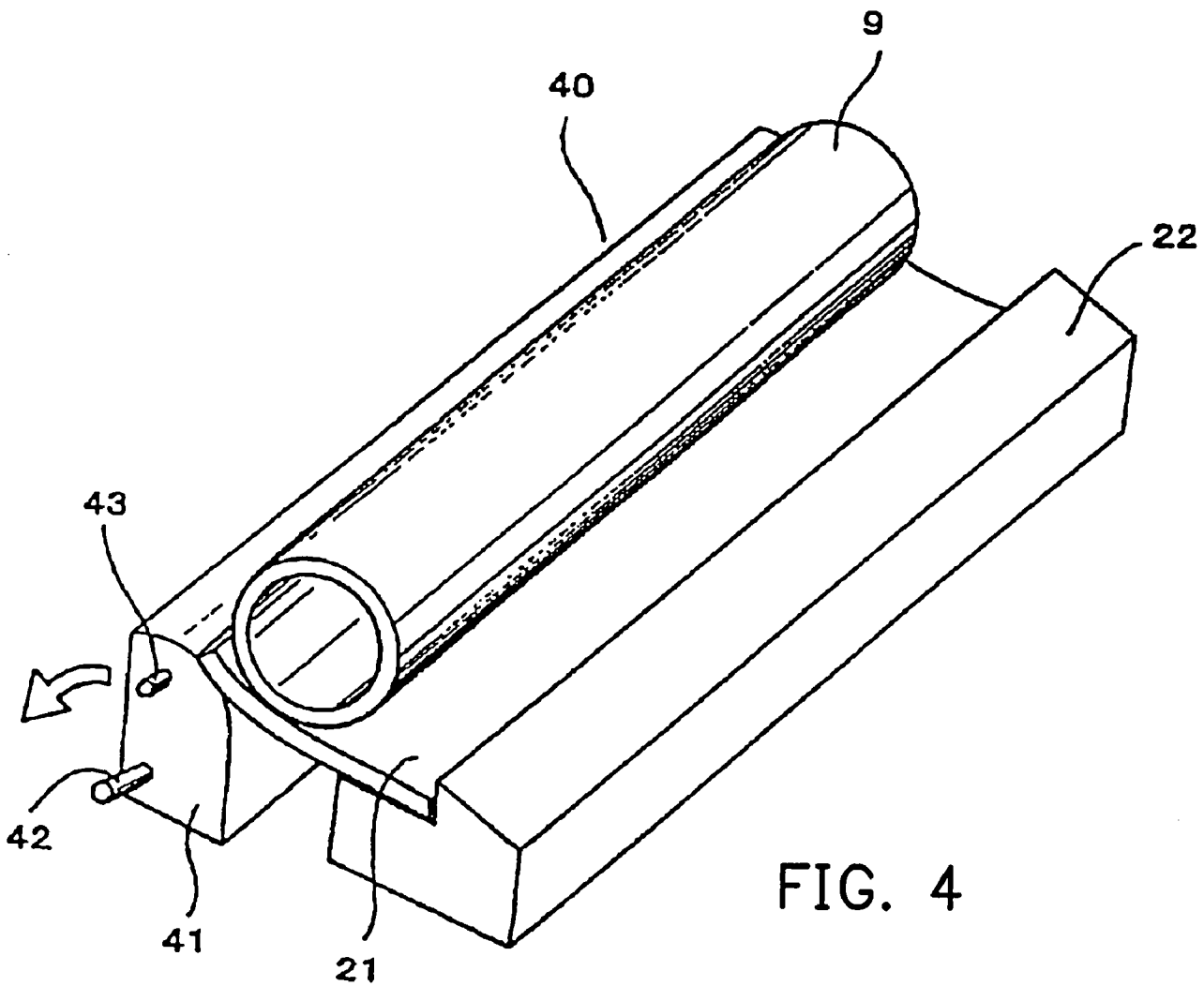
FIG. 4 shows a device structure according to the second embodiment of the invention.

FIG. 4 shows a device structure according to the second embodiment. The sheet unit position regulating unit 40 comprises a cam 41, a rotational shaft 42, and a lever 43. The cam 41 is a cylinder whose base is elliptical, and is divided into four sections by a plane containing a central axis and most separated points and a plane containing the central axis and less separated points. The rotational shaft 42 is formed in a vicinity of the central axis on the two side faces along the longitudinal direction, and the lever 43 is formed in a vicinity of the most separated point on the two side faces along the longitudinal direction.

The second embodiment uses the sheet unit position regulating unit 40 to substitute the sheet unit position regulating unit 35.

Figure 5:
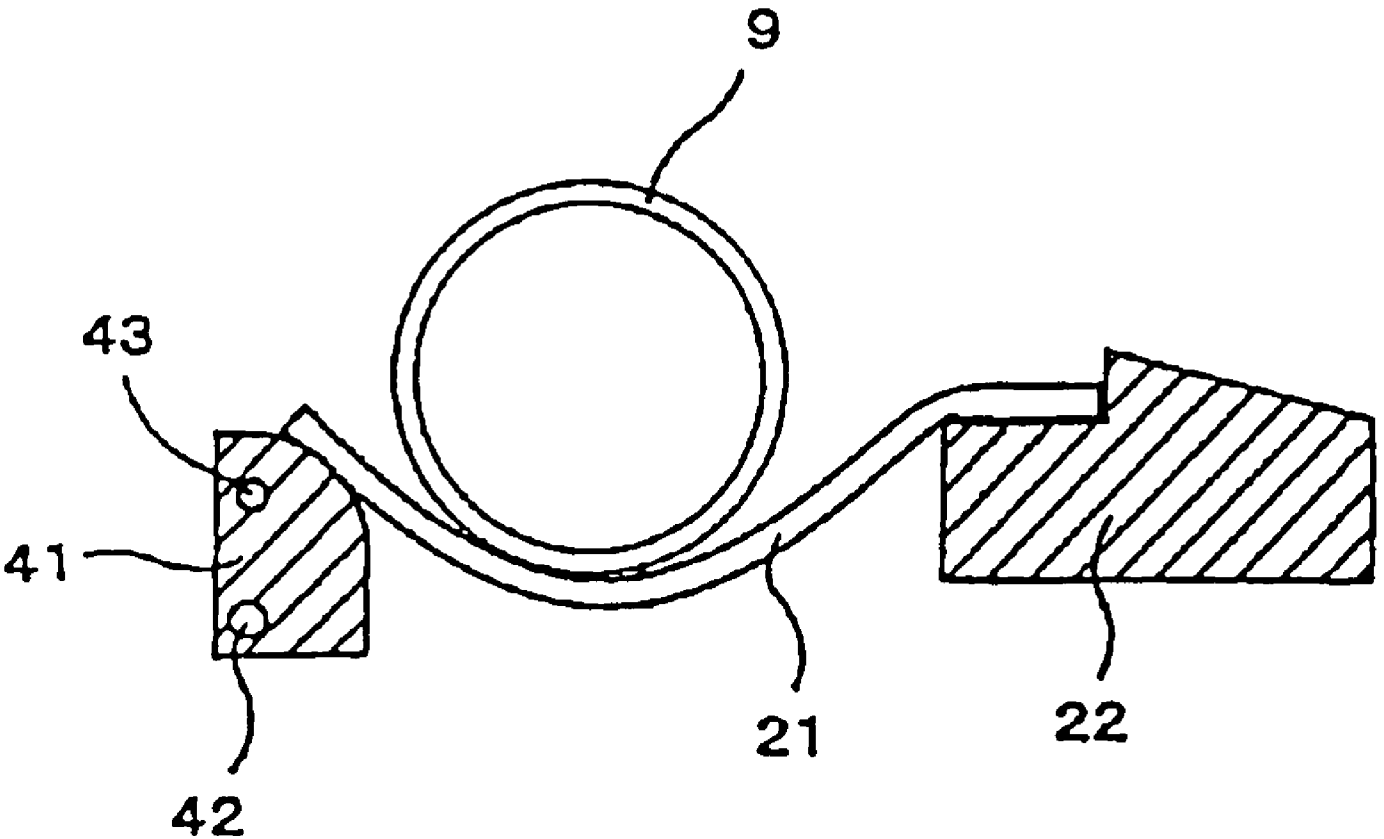
FIG. 5 shows a status when the two ends of the sheet unit are in contact with the vicinity of the most separated points.
Figure 6:
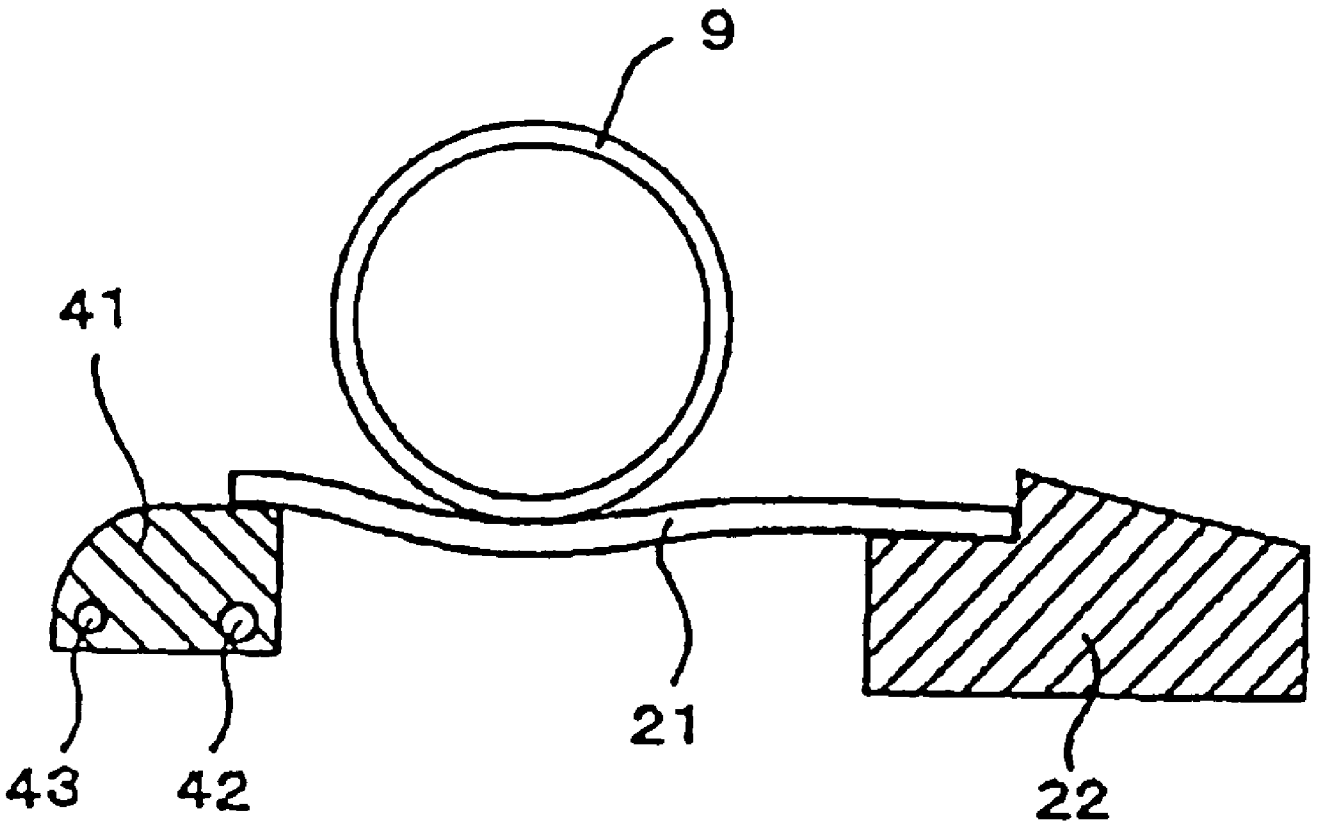
FIG. 6 shows a status when the two ends of the sheet unit are in contact with the vicinity of the less separated points.
Figure 7:
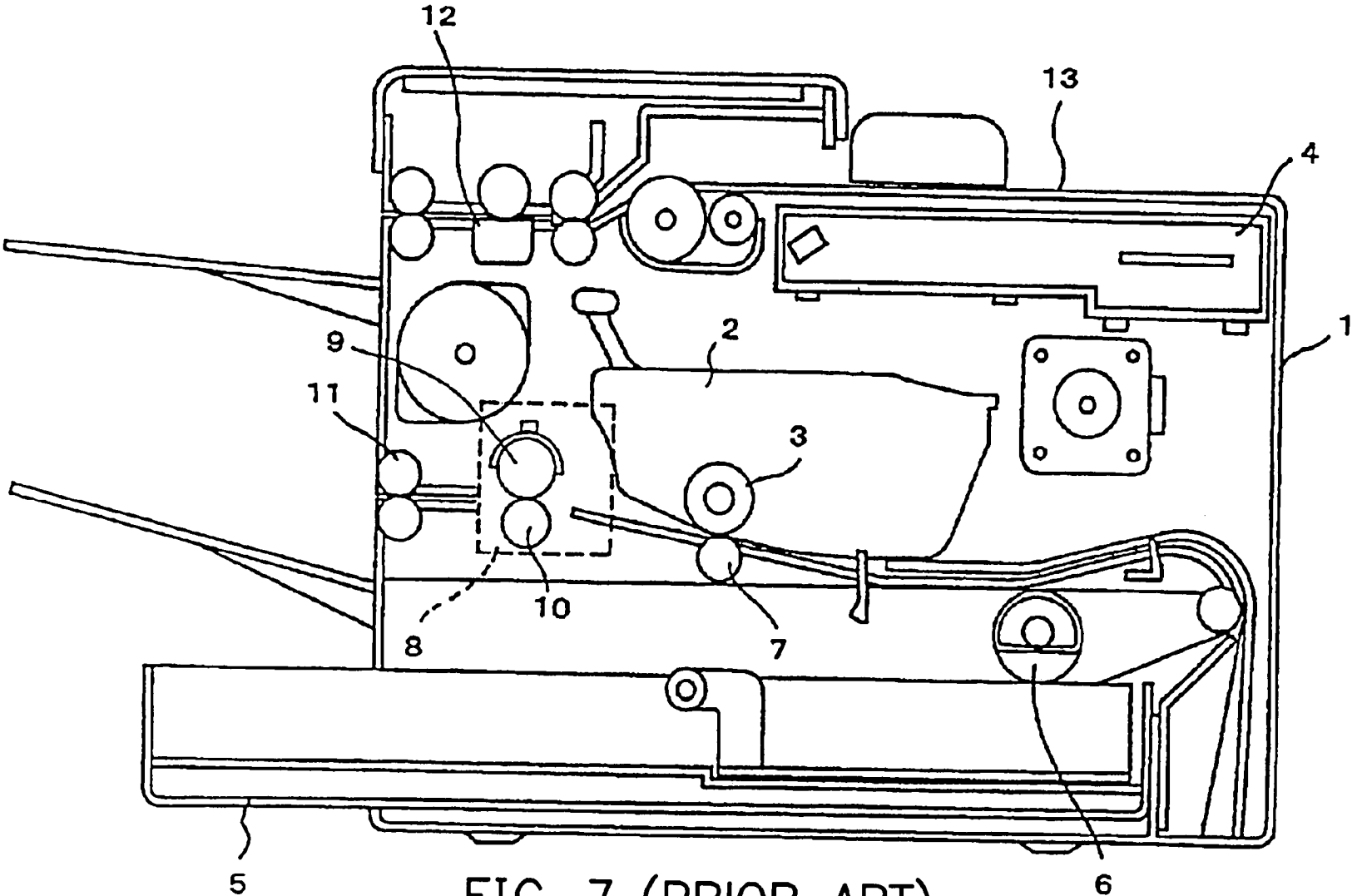
FIG. 7 (PRIOR ART)
FIG. 7 is a side view of an inter structure of a facsimile device having a conventional fixing device and a conventional image forming device.
Figure 8:
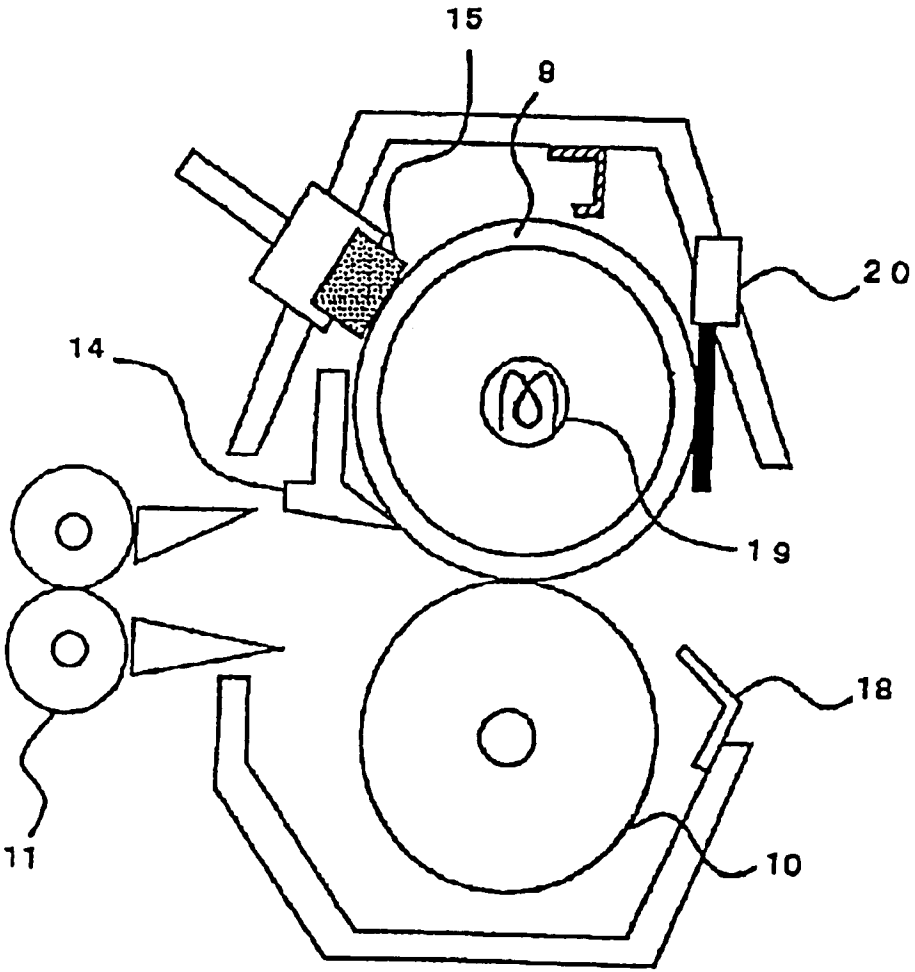
FIG. 8 (PRIOR ART)
FIG. 8 is a side view of an inter structure of a conventional fixing device.

As shown in FIG. 5, when the lever 43 is operated to make the two ends of the sheet unit to contact with in a vicinity of the most separated positions, the nip width at the central portion of the sheet unit 21 does not change too much and the nip width at the two ends can be increased. In addition, when the lever 43 is operated to make the two ends of the sheet unit to contact with in a vicinity of the less separated positions, the nip width at the central portion of the sheet unit 21 does not change too much and the nip width at the two ends can be decreased. For example, when an ordinary recording paper is used, the nip width is set a small value, and the nip width is increased for a thick recording paper, by which the fixing property at the ends upon the beginning of the fixing process can be satisfied.

According to the above description, the lowest position of the two ends of the sheet unit 21 can be adjusted. In this way, a necessary nip width on the end corresponding to the thickness of the recording paper can be set.

As described above, according to the present invention, the nip width on the two ends is larger than that on the central portion at the nip portion between the heat transmitting unit and the sheet unit. Therefore, the recording paper can be pressed to be in contact with the heat transmitting unit for a longer time, and the fixing property on the two ends can be improved.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A fixing device, comprising:

a heat transmitting unit, having a heating source;

a sheet unit, in contact with the heat transmitting unit, configured to apply a pressure;

an installation fitment arranged at an upstream side of a transporting direction of a recording paper with respect to the heat transmitting unit and configured to fix one end of the sheet unit on the upstream side of the heat transmitting unit, wherein an other end of the sheet unit is pressed to be in contact with the heating transmitting unit so as to define a nip portion through which the recording paper on which a toner image has been transferred is transported to fix the toner image, and a first nip width of a central portion of the sheet unit is smaller than a second nip width of an outer portion of the sheet unit.

2. The fixing device of claim 1, further comprising a sheet regulating unit for varying a height of the other end of the sheet unit.

3. The fixing device of claim 1, wherein a length of the sheet unit in the recording paper transporting direction becomes shorter while approaching a central portion of the nip portion, and becomes longer than that at the two ends of the nip portion.

4. The fixing device of claim 3, wherein the nip portion is substantially a U shape.

5. The fixing device of claim 1, further comprising a sheet regulating unit configured to adjust a height of the other end so a first nip width at a central portion of the sheet unit changes less than a second nip width at an outer portion of the sheet unit.

6. An image forming device, comprising:

a fixing device, including, a heat transmitting unit, having a heating source;

a sheet unit, in contact with the heat transmitting unit and configured to apply a pressure; and an installation fitment arranged at an upstream side of a transporting direction of a recording paper with respect to the heat transmitting unit and configured to fix one end of the sheet unit on the upstream side of the heat transmitting unit, wherein an other end of the sheet unit is pressed to be in contact with the heat transmitting unit so as to define a nip portion through which the recording paper on which a toner image has been transferred is transported to fix the toner image, and a first nip width of a central portion of the sheet unit is smaller than a second nip width of an outer portion of the sheet unit.

7. The image forming device of claim 6, further comprising a sheet regulating unit for varying a height of the other end of the sheet unit.

8. The image forming device of claim 6, wherein a length of the sheet unit in the recording paper transporting direction becomes shorter while approaching a central portion of the nip portion, and becomes longer than that at the two ends of the nip portion.

9. The image forming device of claim 8, wherein the nip portion is substantially a U shape.

10. The image forming device of claim 6, further comprising a sheet regulating unit configured to adjust a height of the other end so a first nip width at a central portion of the sheet unit changes less than a second nip width at an outer portion of the sheet unit.

11. A fixing device, comprising:

a heat transmitting unit including a heating device;

an attaching stage disposed upstream of a transporting direction of a recording medium with respect to the heat transmitting unit; and a sheet unit including a first end and a second end, the first end attached to the attaching stage, the second end including a nip portion, and the nip portion including a first nip width and a second nip width larger than the first nip width.

12. The fixing device of claim 11, further comprising a sheet regulating unit for varying a height of the second end of the sheet unit.

13. The fixing device of claim 11, further comprising a sheet regulating unit configured to adjust a height of the second end so a first nip width at a central portion of the sheet unit changes less than a second nip width at an outer portion of the sheet unit.

14. The fixing device of claim 11, wherein the nip portion is substantially concave.

15. An image forming device including a fixing device, the fixing device comprising:

a heat transmitting unit including a heating device;

an attaching stage disposed upstream of a transporting direction of a recording medium with respect to the heat transmitting unit; and a sheet unit including a first end and a second end, the first end attached to the attaching stage, the second end including a nip portion, and the nip portion including a first nip width and a second nip width larger than the first nip width.

16. The image forming device of claim 15, further comprising a sheet regulating unit for varying a height of the second end of the sheet unit.

17. The image forming device of claim 15, further comprising a sheet regulating unit configured to adjust a height of the second end so a first nip width at a central portion of the sheet unit changes less than a second nip width at an outer portion of the sheet unit.

18. The image forming device of claim 15, wherein the nip portion is substantially concave.

* * * * *